US006026890A

United States Patent [19]

Akachi

[11] Patent Number: 6,026,890

[45] Date of Patent: Feb. 22, 2000

[54] HEAT TRANSFER DEVICE HAVING METAL BAND FORMED WITH LONGITUDINAL HOLES

[75] Inventor: Hisateru Akachi, Sagamihara, Japan

[73] Assignees: Actronics Kabushiki Kaisha, Isehara; Hisateru Akachi, Sagamihara, both of Japan

[21] Appl. No.: 08/670,819

[22] Filed: Jun. 25, 1996

[30] Foreign Application Priority Data

Jun. 29, 1995 [JP] Japan ..... 7-196919

[51] Int. Cl.[7] ..... F28D 15/00

[52] U.S. Cl. ..... 165/104.26; 165/46; 165/177

[58] Field of Search ..... 165/104.26, 104.21, 165/104.33, 46, 104.14, 171, 177

[56] References Cited

U.S. PATENT DOCUMENTS

| | | | |
|---|---|---|---|
| 4,212,347 | 7/1980 | Eastman | 165/46 |
| 4,825,661 | 5/1989 | Holtzapple et al. | 165/104.26 X |
| 4,830,100 | 5/1989 | Kato et al. | 165/104.14 |
| 4,921,041 | 5/1990 | Akachi | 165/104.26 |
| 5,219,020 | 6/1993 | Akachi | 165/104.26 |
| 5,323,292 | 6/1994 | Brzezinski | 165/104.33 X |
| 5,343,940 | 9/1994 | Jean | 165/104.33 |
| 5,404,938 | 4/1995 | Dinh | 165/104.14 X |
| 5,647,430 | 7/1997 | Tajima | 165/104.33 |
| 5,660,229 | 8/1997 | Lee et al. | 165/104.14 X |
| 5,697,428 | 12/1997 | Akachi | 165/104.14 X |

FOREIGN PATENT DOCUMENTS

| | | | |
|---|---|---|---|
| 1284506 | 12/1968 | Germany | 165/104.33 |
| 7-30024 | 1/1995 | Japan . | |
| 94/00725 | 1/1994 | WIPO . | |

OTHER PUBLICATIONS

Patent Abstracts of Japan, vol. 014, No. 327 (M–0998), Jul. 13, 1990 & JP 02 110296 A (Nippon Alum Mfg Co Ltd), Apr. 23, 1990, & JP 02 110296 A.

*Primary Examiner*—Christopher Atkinson
*Attorney, Agent, or Firm*—Foley & Lardner

[57] ABSTRACT

A heat exchanger utilizes a multi-hole flexible band of light metal which is formed, by extrusion, with a plurality of longitudinal small holes extending in parallel to one another from one band end to the other end. The longitudinal holes are connected at each of the end portions of the band, and both ends of the band is closed by welding to form a sealed cavity partly filled with a working fluid in partial vacuum. The sealed cavity may be in the form of a single long continuous passage, or in the form of parallel passages connected together at both ends. The multi-hole band is bent in such a shape that the band meanders between a high temperature region and a low temperature region. The thus-constructed heat exchanger is advantageous in heat exchanging performance, and capable of reducing the manufacturing and material costs, the weight of the heat exchanger, and improving the reliability.

14 Claims, 6 Drawing Sheets

PRIOR ART

HEAT TRANSFER DEVICE HAVING METAL BAND FORMED WITH LONGITUDINAL HOLES

BACKGROUND OF THE INVENTION

The present invention relates to a structure of a heat pipe type heat exchanger.

There is known a meandering capillary tube heat pipe different from an ordinary heat pipe. In the meandering capillary tube heat pipe, vapor bubbles and liquid droplets of working fluid are distributed alternately over the inside cavity of the capillary tube, filling and closing the inside of the capillary tube by the surface tension, and a pressure wave due to nucleate boiling at the heat absorbing portion generates vibrations of the vapor bubbles and liquid droplets along the longitudinal (or axial) direction so that heat is transferred from a high temperature side to a low temperature side. The heat transfer device of this type is disclosed more in detail in various forms in U.S. Pat. Nos. 4,921,041 and 5,219,020. The disclosures of these U.S. Patents are herein incorporated by reference. This type heat pipe shows excellent heat transporting performance even in a top heat mode in which the high temperature region is above the low temperature region. Furthermore, the capillary tube is flexible, and fins are not required. Accordingly, the meandering capillary type heat pipe can fulfill the recent demand for smaller size and lighter weight.

This meandering capillary tube heat pipe is used as a heat exchanger in a heat receiving portion or heat radiating portion in various heat exchanging equipment. As one example of related art, a Japanese Patent provisional Publication No. 7-30024 shows a large capacity "kenzan" type heat sink.

This heat sink is a kind of a heat exchanger in which a capillary heat pipe extends back and forth repeatedly between the heat absorbing high temperature region and the heat releasing low temperature region. FIG. 10 is a perspective view showing the structure of this heat sink. The heat sink shown in FIG. 10 has a heat receiving base plate 11 having a heat receiving surface 11-1 for absorbing heat from a heating member, cross bars 12 for transferring heat from the base plate 11, and a group of slender projections 13 each consisting of a l-shaped capillary tube segment serving as a heat pipe. This heat sink is similar in shape to a "kenzan" which is a spiked device (or frog) used to support stems in a flower arrangement. A heat releasing portion constituted by these projections 13 is cooled by a convection air flow 14. Each projection 13 has a projecting looped portion serving as a low temperature heat releasing side, and a base portion which is clamped by a pair of the cross bars 12 and which serves as a high temperature heat absorbing side.

In this heat sink, it is easy to further increase the capacity of the heat sink by increasing the height of the projections and increasing the number of turns (or the number of the projections). From the nature of the meandering capillary tube heat pipe, this heat sink can function properly without regard to the posture assumed in the mounted state. It is possible to mount this heat sink in such a posture that the projections 13 are placed horizontally or upside down. The direction of the convection flow of the cooling fluid may be right or left, or up or down. Irrespective of the direction of the convection flow, this heat sink can perform satisfactorily. The projections 13 further serve as cooling fins, so that there is no need for further providing fins. Therefore, this heat sink is small in size and light in weight for its heat releasing capacity.

In this heat sink, it is necessary to increase the number of turns in order to enhance the performance. This heat sink, however, requires a troublesome and time-consuming operation for arranging multitudes of the projection 13, and this requirement becomes more severe when the number of turns is to be increased to enhance the performance. Besides, this operation is unsuited for automatic process and impeditive to cost reduction. Furthermore, the forest of the pin-shaped projections 13 increases the pressure drop of the convection flow, and hence increases the load of a cooling fan. This heat sink is limited in improvement of the heat radiating capability because fins cannot be attached to the capillary tube. If the number of turns is increased too much, the pressure drop increases and the flow speed of the heat medium fluid decreases, resulting in a decrease in the heat radiating performance.

SUMMARY OF THE INVENTION

It is therefore an object of the present invention to provide a heat exchanger or heat transfer device which is advantageous in production cost and time, and superior in heat transfer performance.

According to the present invention, a heat transfer device or a heat exchanger comprises at least one metal heat pipe unit defining a sealed inside cavity partially filled, in a partial vacuum, with a predetermined amount of working fluid capable of condensation and vaporization. The metal heat pipe unit comprises a heat absorbing portion for absorbing heat in a high temperature region, and a heat releasing portion for releasing heat in a low temperature region. In this device, the metal heat pipe unit comprises a flexible multi-hole metal band or ribbon made of light metal. The metal band extends along a longitudinal direction from a first longitudinal band end to a second longitudinal band end, and the metal band is formed with a plurality of longitudinal holes extending along the longitudinal direction of the band. The longitudinal holes are connected with one another to form the sealed inside cavity. This metal band is bent in such a sinuous manner that the metal band extend back and forth between the high temperature region and the low temperature region. In the cavity formed by the longitudinal holes, the working fluid is in the form of liquid droplets and vapor bubbles formed by nucleate boiling, and transfers heat mainly by vibrations of the working fluid.

The metal band having the longitudinal holes can be formed by the technique of press extrusion which has recently made remarkable advances. In particular, the extrusion of lightweight, ductile metal or allow such as metal or allow of aluminum or magnesium makes it possible to make a multi-hole in a long tape form having parallel longitudinal small holes. For example, it is possible to make the diameter of each longitudinal hole equal to 0.9 mm or less, and form 20 of the longitudinal holes in a tape-like metal band having a width equal to or smaller than 20 mm and a thickness equal to or smaller than 1.3 mm. The length of such a metal band can reach several hundreds of meters. The metal band of light metal is superior in flexibility. The multi-hole metal band is suitable for making a plate-type heat pipe unit having a plurality of capillary tubes therein. In this case, the ends of the longitudinal holes are closed at both ends of the metal band to form one closed tunnel or more, and the working fluid in a quantity less than the volume of the closed tunnel is sealed in vacuum in the tunnel. Tens of long small holes can be formed at once in a metal band, and these long holes can be connected, by a predetermined means, to form a continuously meandering single tunnel having tens of parallel tunnel segments. When the thus-constructed metal band is bent in such a sinuous form as to extend back and force repeatedly between the high temperature region and the lower temperature region, the single continuous tunnel meanders, making hundreds of turns as the result of addition of the turns of the tunnel in the metal band, and the turns of the metal band itself, between the high and lower temperature regions. This arrangement can improve the performance of the capillary tube type heat pipe by increasing the number of turns of the capillary tube significantly.

DETAILED DESCRIPTION OF THE INVENTION

Figure 1:
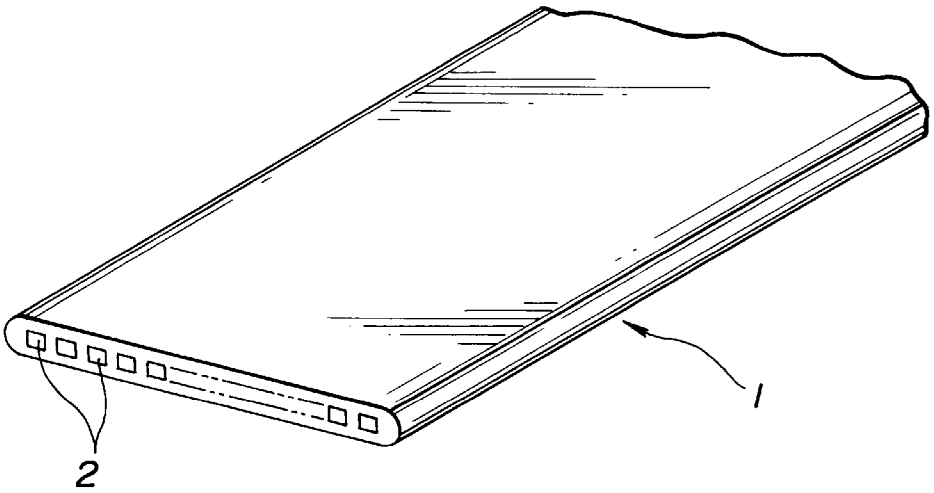
FIG. 1 is a perspective view showing a multi-hole flexible metal band which can be employed in preferred embodiments of the present invention.

FIG. 1 shows a multi-hole flat metal band (or ribbon) 1 employed in the present invention. The metal band 1 is made of a light metal such as aluminum metal or alloy, or magnesium metal or alloy. The metal band 1 of the example shown in FIG. 1 is in the form of a long flexible strip having uniform width and thickness. This multi-hole metal band 1 can be formed by the technique of press extrusion. By this forming process, it is possible to produce the metal band 1 having a width in a range from several mm to 80 mm, a thickness in a range from a lower limit of 1 mm to several mm, and a length of several hundreds of meters. The upper and lower surfaces of the metal band 1 are so flat and smooth that semiconductor heater elements can be directly mounted, and various fins can be equipped. With these features, the metal band 1 can fulfill the conditions required for a capillary heat pipe type heat exchanger.

The metal band 1 has a plurality of longitudinal small holes 2 extending over the entire length of the metal band 1. In this example, the longitudinal holes 2 extend in parallel to one another and they are arranged regularly in an imaginary slicing plane which is parallel to, and intermediate between, the upper and lower surfaces. When, for example, the thickness of the metal band 1 is 2 mm, a lower limit of a spacing between two adjacent holes 2 is 0.3 mm. It is possible to determine the hole spacing appropriately over this limit, but it is desirable to make the hole spacing as small as possible to improve characteristics of the heat pipe. In this example shown in FIG. 1, each hole 2 has a rectangular cross section. The width of the holes 2 can be determined appropriately in a range equal to or greater than a lower limit of 0.5 mm, and the depth of the holes 2 can be also determined appropriately in a range equal to or greater than a lower limit of 0.5 mm. However, it is desirable to make the hole width equal to or greater than 0.6 mm and the hole depth equal to or greater than 0.6 mm for ease of processing the ends of the holes. In one example in which the multi-hole metal band 1 of pure aluminum having a width of 19 mm, and a thickness of 1.3 mm is formed with 19 of the longitudinal holes 2 each of which is 0.6 mm wide, and 0.7 mm deep, the strength against internal pressure of the metal band 1 is estimated by calculation to be 200 $Kg/cm^2$. This withstanding internal pressure is ten times greater than that of a conventional cylindrical heat pipe. This metal band 1 can significantly widen the operating temperature range for a two-phase working fluid of every kind, and sufficiently increases the safety against variation in the heat load of the heat exchanger.

Figure 2:
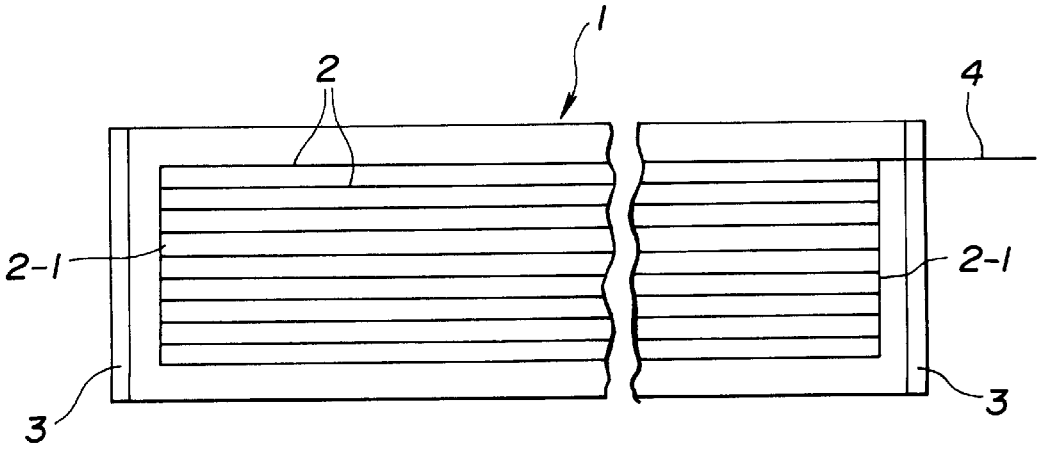
FIG. 2 is a schematic sectional view showing a first pattern of fluid passages which can be employed in each preferred embodiment of the present invention.
Figure 3:
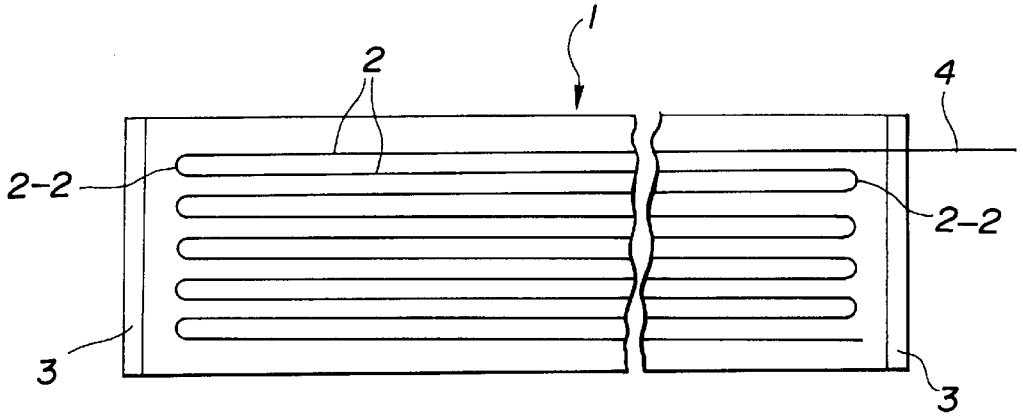
FIG. 3 is a schematic sectional view showing a second fluid passage pattern which can be employed instead of the first pattern in each preferred embodiment.

FIGS. 2 and 3 are schematic sectional views showing two possible patterns of the holes 2 in an imaginary slicing plane dividing the platelike metal band 1 into two substantially equivalent slices each of which is substantially a mirror image of the other. In FIGS. 2 and 3, the longitudinal holes 2 are shown by lines for simplification. Each of FIGS. 2 and 3 shows the metal band 1 in a preparing step of a process for producing a meandering metal band container.

In the example of FIG. 2, the metal band 1 extends longitudinally from a first longitudinal end 3 to a second longitudinal end 3. Both ends 3 are hermetically closed, in this example, by welding. Each longitudinal hole 2 extends from a first hole end near the first band end 3 of the metal band 1 to a second hole end near the second band end 3. In the pattern of FIG. 2, the first hole ends of the parallel longitudinal holes 2 are connected together by a first terminal lateral hole 2-1. Similarly, the second hole ends of the parallel longitudinal holes 2 are connected together by a second terminal lateral hole 2-1. In this way, the longitudinal holes 2 are connected in parallel between the first and second terminal lateral holes 2-1.

In the pattern of FIG. 3, the parallel longitudinal holes 2 are connected so as to form a single continuous sinuous passage (or tunnel). In any three consecutive longitudinal holes 2 including an intermediate one between first and second adjacent ones, one hole end of the intermediate longitudinal hole 2 is connected by a short connecting hole 2-2 with an adjacent hole end of the first adjacent longitudinal hole 2, and the other hole end of the intermediate longitudinal hole 2 is connected by a short connecting hole 2-2 with an adjacent hole end of the second adjacent longitudinal hole. Each short connecting hole 2-2 is shown by a U-shaped line segment in FIG. 3. The working fluid is introduced into the inside cavity formed by the longitudinal holes 2 through a passage 4, and then the inside cavity is sealed up.

In the following embodiments of the present invention, it is possible to employ either of the patterns of FIG. 2 and FIG. 3.

Figure 4:
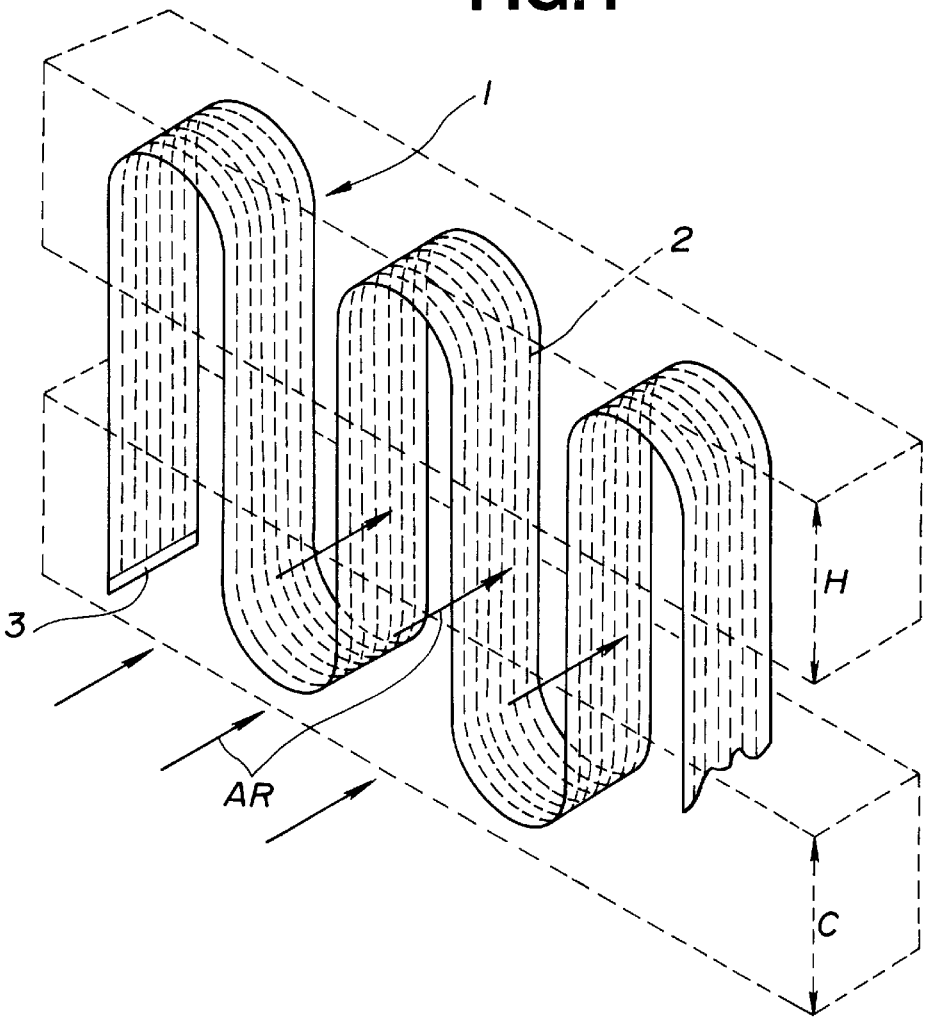
FIG. 4 is a perspective view showing a heat pipe type heat exchanger according to a first preferred embodiment of the present invention.

FIG. 4 shows the first embodiment of the present invention which employs a basic structure according to the present invention. As shown in FIG. 4, the multi-hole metal band 1 is bent in a serpentine form. The metal band 1 extends back and forth between a high temperature (heat absorbing) region H and a low temperature (heat releasing) region C. The metal band 1 extends in a first direction from the low temperature region C to the high temperature region H, makes a U-shaped turn in the high temperature region H, then extends in a second direction from the high temperature region H to the low temperature region C, then makes a U-shaped turn in the low temperature region C and extends in the first direction again from the low temperature region C to the high temperature region H. By repeating this cycle, the metal band 1 describes an undulating wave form. The metal band 1 of this embodiment comprises a plurality of straight band segments extending between the low and high temperature regions C and H, a plurality of first U-shaped band segments located in the high temperature region H and a plurality of second U-shaped band segments in the low temperature region C. These band segments are integral parts of the continuous metal band 1. In the example shown in FIG. 4, the straight band segments are flat and parallel to one another, and arranged at regular intervals. The high temperature region H may be above the low temperature region C.

A predetermined working fluid is sealed in the connected longitudinal holes 2. The amount of the fluid is less than the volume of the inside cavity formed by the longitudinal holes 2. In this way, the multi-hole metal band 1 forms a container serving as a capillary type heat pipe.

In this example, each of the first and second surfaces of the metal band 1 is substantially a ruled surface generated by moving a straight line (that is, a generatrix) along a sinuous curved line in a flat plane so that said straight line remains perpendicular to the flat plane. The metal band 1 of FIG. 4 describes the undulating wave form as mentioned before, and the simultaneous curved line in the flat plane is in the form of an undulating plane curve. The heat transfer device according to the first embodiment further comprises a means for directing streams AR of a heat medium fluid in a direction perpendicular to the flat plane. The stream directing means may comprise any one or more of casing, shell, duct and baffle. In this arrangement, one lateral edge of the band 1 is on the upstream side, and the other lateral edge is on the downstream side, so that the heat medium fluid flows in the widthwise direction of the band 1.

It is possible to employ either of the patterns shown in FIGS. 2 and 3. The pattern of FIG. 2 is advantageous when an increase in the amount of heat transfer of the heat pipe is an important factor. The pattern of FIG. 3 is preferable when the heat pipe is required to function properly without being affected readily by the gravitation. In the case of FIG. 2, the number of turns of the tubular passage is small, but the parallel combination of many holes 2 can constitute a heat pipe which is low in pressure drop in the tubular passage, and hence increase the maximum heat transportation quantity. In the case of FIG. 3, the number of turns is very great, so that the heat pipe is low in dependency on gravity because of the nature of the serpentine capillary heat pipe, and capable of functioning properly without being readily affected by the attitude of the heat pipe, vibrations, and centrifugal force.

Figure 5:
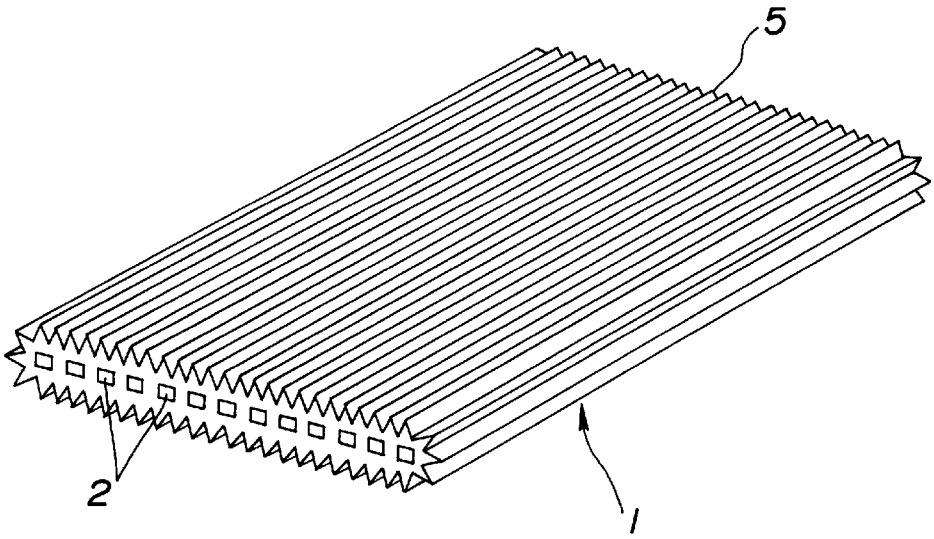
FIG. 5 is a perspective view showing a finned multi-hole flexible metal band which can be employed in the present invention.

FIG. 5 shows a metal band 1 integrally formed with fins 5 extending in the longitudinal direction of the metal band 1. It is possible to employ the finned metal band shown in FIG. 5 instead of the finless plain metal band 1 shown in FIG. 1. These fins 5 can be formed integrally by the metal extrusion process. Preferably, the fins 5 are fine enough to facilitate the bending operation of the metal band 1. The finned metal band 1 shown in FIG. 5 is superior in convection heat transfer rate with the increased surface area, but inferior in heat transfer rate by contact between the metal band and the heating member of the heat receiving portion. Therefore, the finned metal band 1 is not appropriate when the heat receiving means utilizes the heat conduction between metal members. The finned metal band 1 is advantageous especially when applied to a heat exchanger utilizing convection for heat exchange in both of the heat absorbing portion and the heat releasing portion.

Figure 6:
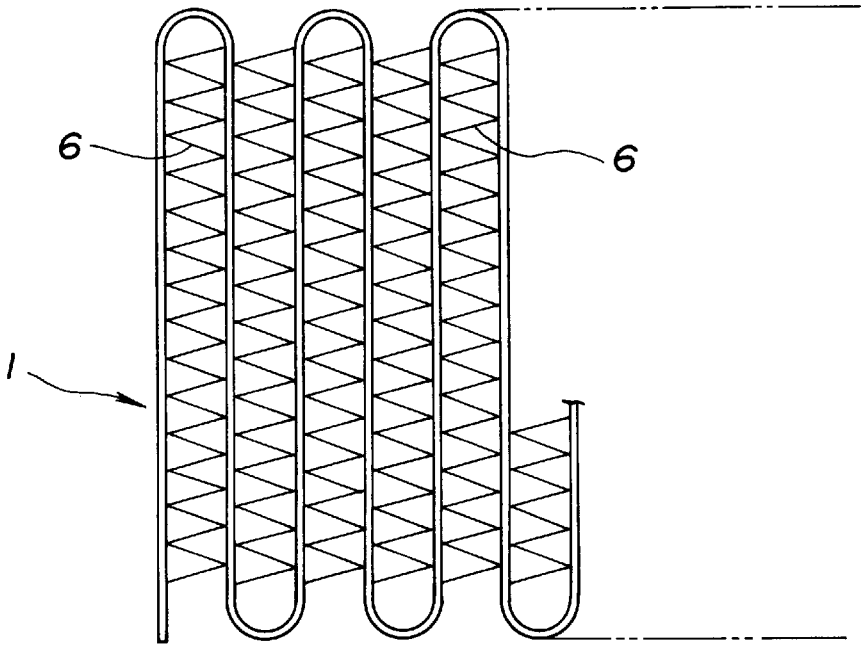
FIG. 6 is a sectional view of a heat exchanger according to a second embodiment of the present invention.

FIG. 6 shows a second embodiment of the present invention. A multi-hole metal band 1 shown in FIG. 6 meanders in the serpentine form as in the example shown in FIG. 4. In the example of FIG. 6, there are further provided interspace fins 6 disposed between any two adjacent straight band segments of the meandering metal band 1. In this example, a series of the interspace fins 6 is formed by attaching a thin tape bent in a zigzag form between two adjacent straight band segments. This structure shown in FIG. 6 is light in weight but high in rigidity like a honeycomb structure. The heat exchanger according to the second embodiment is significantly improved in strength against external pressure and vibrations. In particular, the structure shown in FIG. 6 is exempt from danger of damage due to resonance, and hence very suitable for a heat exchanger used in a severe situation, as in a vehicle, where the heat exchanger must endure violent vibrations in all directions and centrifugal forces. In the example shown in FIG. 6, the interspace fins 6 are applied to the metal band 1 in the serpentine form. However, the second embodiment is not limited to the serpentine form, but applicable to any other form of the metal band 1. Fins of the type shown in FIG. 6 can be attached to multi-hole metal bands in various forms.

Figure 7:
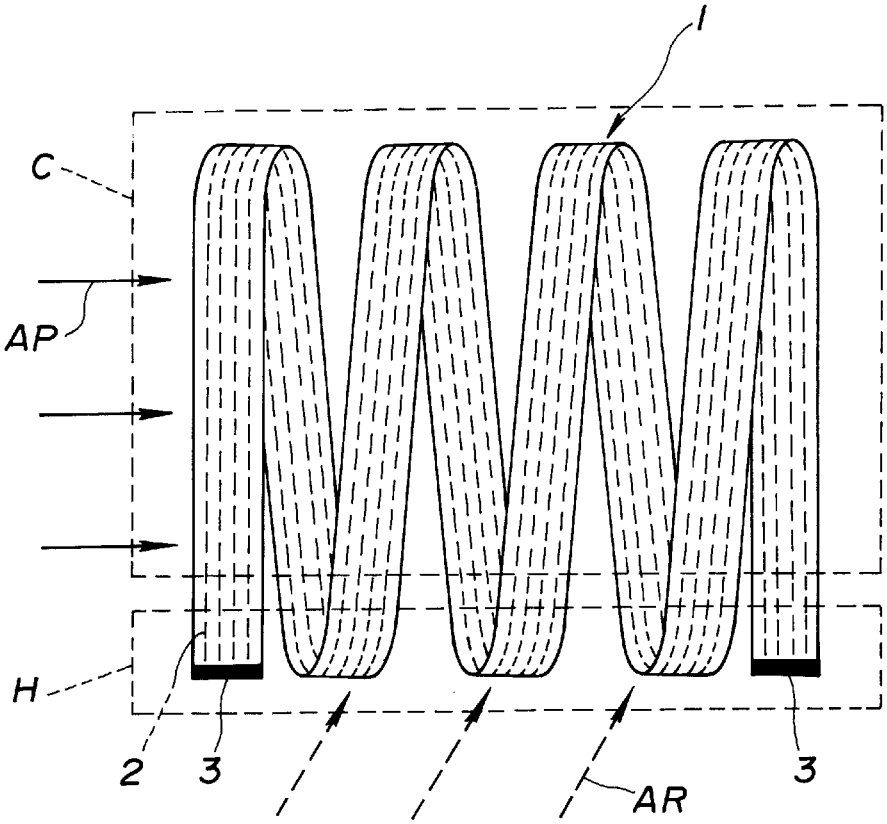
FIG. 7 is a perspective view for illustrating third and fourth embodiments of the present invention.

FIG. 7 shows a third embodiment of the present invention. The multi-hole metal band 1 shown in FIG. 7 meanders between the high temperature region H and the low temperature region C in a helical form. Adjustment of the pitch of the helical metal band 1 is easy, and the metal band 1 can be accurately wound at the required pitch. The helically wound metal band 1 can enclose and contain a convection flow AP flowing in parallel to an axis of the helical form with little leakage, and improve the efficiency of heat exchange. When the pitch of the helical form is sufficiently greater than the width of the metal band 1, the third embodiment is applicable to the arrangement in which the convention flow AP is perpendicular, or oblique, to the axis of the helical form. In this case, however, the pressure drop of the convention flow is increased.

A fourth embodiment is a variation of the third embodiment. In the fourth embodiment, the pitch of the helical form is equal to the width of the metal band 1, and the helically wound metal band 1 is in the form of a tube having a closed curved surface, opening only at both ends. The convention stream flows through the tube formed by the helically wound metal band 1 without leaking radially.

Figure 8:
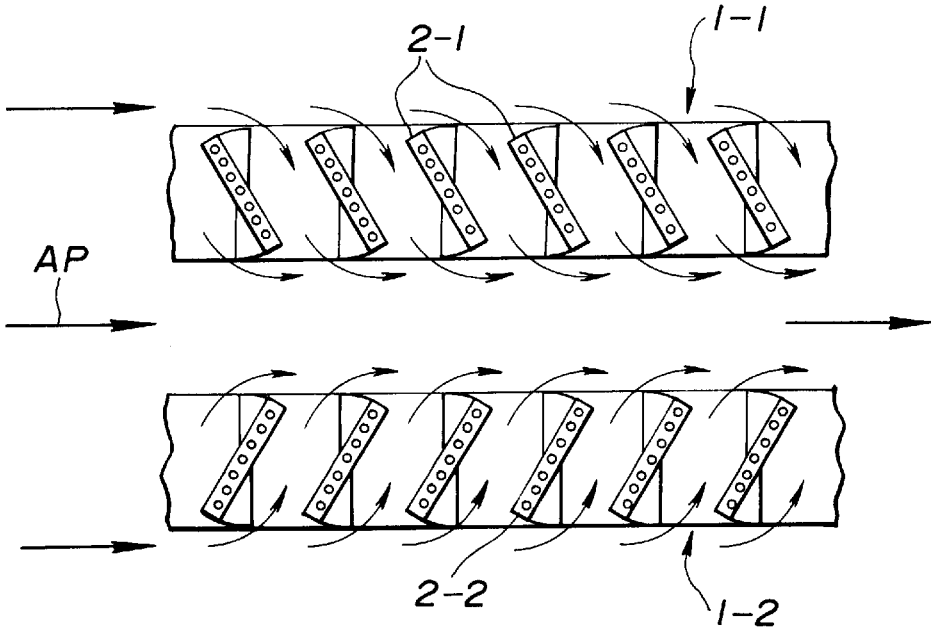
FIG. 8 is a sectional view showing a heat exchanger according to a fifth embodiment of the present invention.

FIG. 8 shows a fifth embodiment of the present invention. In the fifth embodiment, the multi-hole metal band is twisted. In the example shown in FIG. 8 there are provided two of the multi-hole metal bands 1-1 and 1-2. Each metal band 1-1 or 1-2 is not only bent in the serpentine form, but also twisted as shown in FIG. 8. In the first embodiment, a longitudinally extending center line of the metal band 1 meanders in a predetermined imaginary center plane, and each band surface is substantially a ruled surface generated by moving a straight line (generatrix) along a sinuous curve in the center plane so that the straight line remains perpendicular to the center plane. In the fifth embodiment, the straight generatrix line is not always perpendicular to the flat center plane. The fifth embodiment is applicable to the heat exchanger in which the convection flow is perpendicular to the center plane in which the longitudinal center line meanders, and the heat exchanger in which the convection flow is parallel to the center plane. In the example shown in FIG. 8, the convection flow AP is parallel to the center plane, and the twists of the metal bands helps introduce the fresh heat medium fluid toward the downstream side as shown by arrows in FIG. 8, and accordingly prevents the heat exchanging efficiency of the downstream section of the metal band from being decreased by the hot fluid heated by the upstream section of the metal band. The twisting of the metal band is applicable not only to the serpentine form but to the helical form and any other forms as well, to direct the flow of the heat medium fluid in a desired direction.

FIG. 8 is the sectional view obtained by cutting the metal bands 1-1 and 1-2 by a predetermined imaginary intersecting plane. Each metal band has a plurality of twisted band segments which are regularly arranged in a line in the intersecting plane. In the intersecting plane, the twisted segments of each band are inclined with respect to the center plane perpendicular to the intersecting plane, and the twisted segments in the intersecting plane are parallel to one another. The center planes of the two metal bands 1-1 and 1-2 are parallel to each other. Each metal band extends from an upstream end on the left side as viewed in FIG. 8 to an downstream end on the right side along the center plane. Each twisted segment of the first metal band 1-1 extends in the intersecting plane from an outer lateral edge facing away from the second metal band 1-2, to an inner lateral edge facing toward the second metal band 1-2. The outer lateral edge of each twisted segment of the first metal band 1-1 is located on the upstream side of the inner lateral edge of the twisted segment of the first metal band 1-1. Similarly, each twisted segment of the second metal band 1-2 extends along the widthwise direction in the intersecting plane from an outer lateral edge facing away from the first metal band 1-1, to an inner lateral edge facing toward the first metal band 1-1. The outer lateral edge of each twisted segment of the second metal band 1-2 is located on the upstream side of the inner lateral edge of the twisted segment of the second metal band 1-2. Therefore, the heat medium fluid is introduced obliquely from the outer lateral edges of the twisted segments of the first and second metal bands 1-1 and 1-2 to the interspace between the first and second metal bands 1-1 and 1-2.

Figure 9:
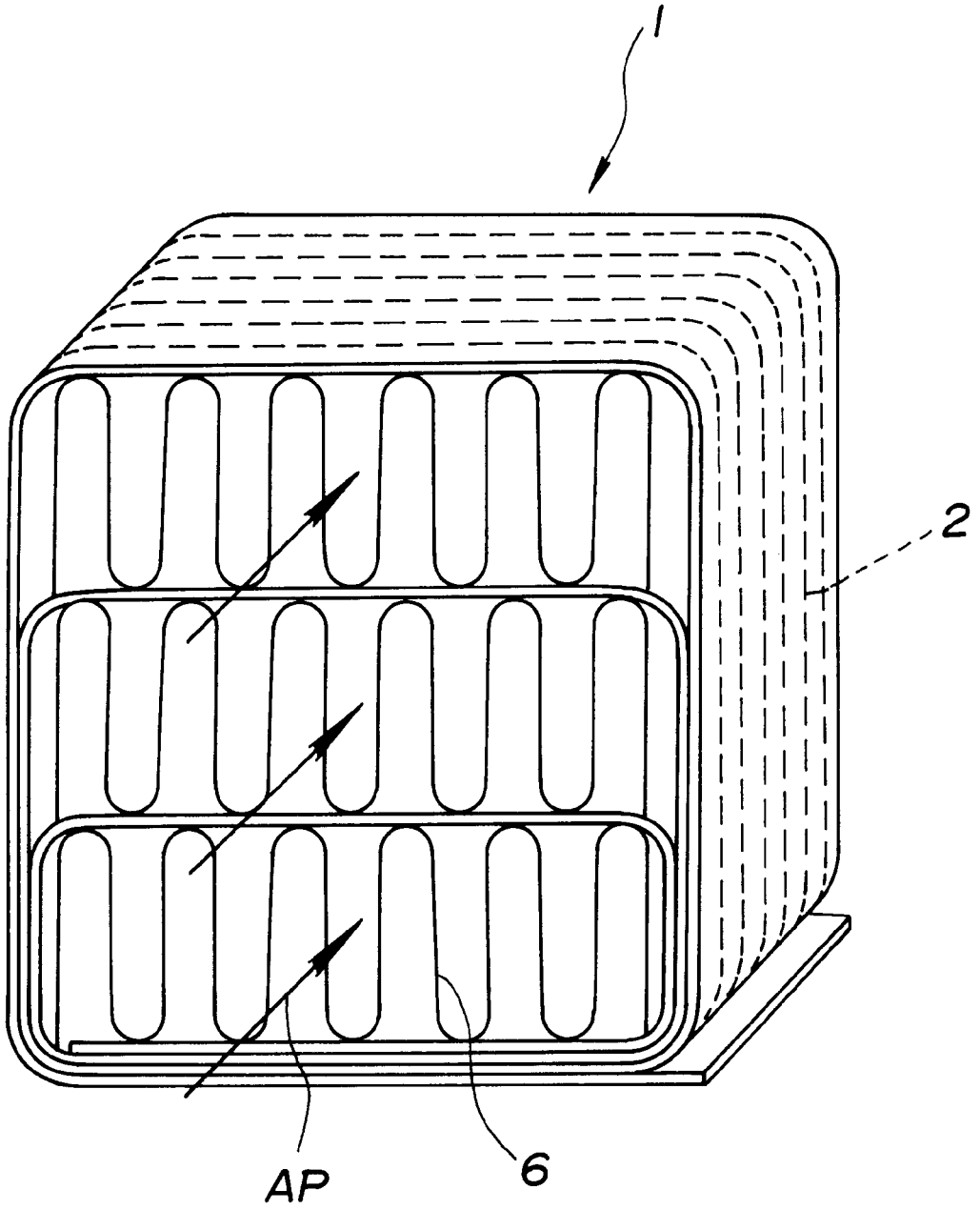
FIG. 9 is a perspective view showing a heat exchanger according to a sixth embodiment of the present invention.
Figure 10:
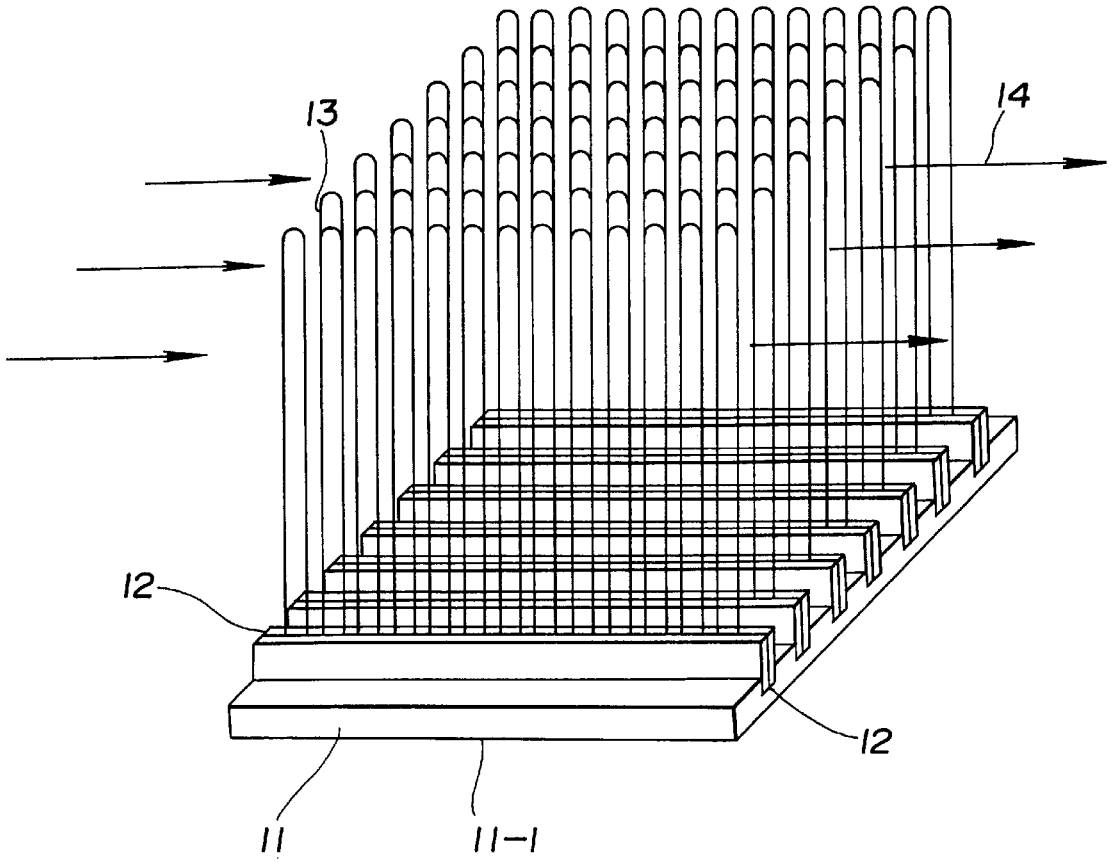
FIG. 10 is a perspective view showing a heat exchanger utilizing a capillary heat pip of a related art.

FIG. 9 shows a sixth embodiment of the present invention in which the multi-hole metal band 1 is wound in a vortical manner so as to describe a spiral in a plane. That is, the longitudinal center line of the metal band 1 is in the form of a spiral in a flat plane. In the example shown in FIG. 9, the metal band 1 is wound substantially in a rectangular or square form by three turns. In the lower side, four band segments are overlapped and joined together. In parallel to this four-layer lower side, there are first and second and third upper band segments. These upper sides are separated one another and each is a single layer segment. In each of the interspace between the first and second upper band segments, the interspace between the second and third upper band segment and the interspace between the third segment and the lower side, a meandering tape is attached to form interspace fins 6. In this example, the four-layer lower side is in contact with the high temperature portion and used as a heat absorbing portion. The remainder is placed in the convection flow of the heat medium fluid and used as a heat releasing portion. In this example, the convention flow is along the widthwise direction of the metal band 1. The width of this structure is determined by the width of the metal band 1, and the length of the tube formed by the metal band 1 is relatively short, so that this structure can reduce the size of the heat exchanger. When a greater heat exchanging capacity is required, it is desirable to connect a plurality of the vortically wound metal bands in series.

The thus-constructed multi-hole metal band heat pipe type heat exchanger according to the present invention offers the following advantages.

(1) A multiplicity of the longitudinal holes 2 are formed all at once in the light metal band 1 by one step of the press extrusion. Therefore, the present invention can significantly reduce the production cost as compared with a heat exchanger having a plurality of capillary tubes formed by a number of production steps such as rolling, multi-step drawing and annealing. The single metal band 1 can have tunnels corresponding to about twenty tubes. As a result, the basic structure according to the present invention shown in FIG. 4 can reduce the material cost to about one tenth of the cost of the conventional heat pipe (when estimated by using a 20 mm wide multi-hole metal band).

(2) The multi-hole metal band eliminates the need for the process for arranging and installing a plurality of separate tubes, so that the working time can be reduced to about one tenth. Since the process for arranging and fixing the capillary tubes occupies a major part of the production time in the conventional system, the cost reduction is very significant.

(3) Because the conventional heat pipe type heat exchanger is so complicated in structure, and the welding operation is difficult, tubes must be made of pure copper. By contrast, the heat exchanger according to the present invention can reduce the total weight significantly by employing, as the material of the metal container, a light metal such as pure aluminum or aluminum alloy.

(4) A bundle of conventional tubes is corrugated even if the tubes are arranged in a plane, so that the conventional device requires heat radiating and heat absorbing plates joined to the heat releasing and absorbing portions to facilitate heat exchange. According to the present invention, both surfaces of the plain metal band are flat and smooth. Therefore, the metal band can be directly attached to a heating member, or a heating element can be directly mounted on the metal band without the interposition of joined plates for heat absorption and radiation. Thus, the present invention can simplify the construction, and further reducing the production time and the weight of the device.

(5) The light metal multi-hole band 1 is far more flexible than copper tubes or stainless alloy tubes, so that the band can be readily formed into a desired shape by bending. Furthermore, it is easy to adjust and correct the shape of the metal band after the completion. In this way, the present invention can increase the flexibility of the design.

(6) The multi-hole metal band can be arranged to hold the band surfaces in such directions to minimize the pressure drop with respect to the flow of the heat medium fluid in a desired direction, so that the heat exchanging performance can be improved.

(7) The multi-hole metal band can be made smooth, and besides the band is capable of being bent and twisted. Therefore, the metal band can be used as a means for guiding and redirecting fluid streams in desired directions to improve the heat exchanging efficiency. In particular, the twisted configuration of the multi-hole metal band makes it easier to introduce the fresh heat medium fluid toward the downstream side so as to uniform the heat exchanging efficiency between the upstream and downstream sides.

(8) The meandering capillary heat pipe can be used without fins, but this heat pipe is limited in heat exchanging efficiency because it is almost impossible to equip the meandering capillary heat pipe with fins. By contrast, the multi-hole metal band is not only usable as a fin-less plain unit, but also very easy of providing fins. With appropriate fins, the metal band can maximize the heat exchanging efficiency. One experiment shows the multi-hole metal band heat pipe equipped with cooling fins increases the heat exchanging capacity twice or more, as compared with the conventional capillary heat pipe, for the same heat exchanging volume.

(9) The meandering capillary heat pipe is not rigid and susceptible to resonant vibrations without an elaborate supporting structure. In the case of the multi-hole metal band, it is very easy to fix fins by welding or some other technique and thereby form a very rigid light-weight structure.

(10) The longitudinal holes of the multi-hole metal band are very small in sectional size, and the multi-hole metal band can withstand very high internal pressures. The multi-hole metal band of pure aluminum can withstand an internal pressure as high as 200 $kg/cm^2$, in contrast to a withstanding internal pressure of 20 $Kg/cm^2$ of the conventional heat pipe, so that the multi-hole metal band can operate safely under high pressure. Therefore, the heat exchanger using the multi-hole metal band enables use of various working fluids near their critical conditions, and significantly widens the operating temperature range of the heat exchanger.

What is claimed is:

1. A heat transfer device comprising:

a metal heat pipe unit defining a sealed inside cavity partially filled, in a partial vacuum, with a predetermined amount of working fluid capable of condensation and vaporization, said metal heat pipe unit comprising a heat absorbing section for absorbing heat in a high temperature region, and a heat releasing section for releasing heat in a low temperature region;

wherein said metal heat pipe unit comprises a flexible platelike metal band which is made of a light metal, which extends along a longitudinal direction from a first longitudinal end to a second longitudinal end, and which is formed with a plurality of longitudinal holes extending along the longitudinal direction, said longitudinal holes being connected with one another to form said sealed inside cavity; and wherein said metal band is bent in such a sinuous manner that said metal band extends back and forth between the high temperature region and the low temperature region, and streams of a heat medium fluid flow substantially parallel to the side faces of the platelike metal band in the regions between the bends.

2. A heat transfer device as claimed in claim 1 wherein said longitudinal holes are formed in a seamless metal piece made by extrusion, and said metal band comprises said seamless metal piece and a closing means for defining said first and second longitudinal band ends of said metal band.

3. A heat transfer device as claimed in claim 2 wherein said metal band is formed with outer fins projecting outwards.

4. A heat transfer device as claimed in claim 3 wherein said outer fins are joined to an outer surface of said metal band.

5. A heat transfer device as claimed in claim 3 wherein said outer fins are integral parts of said seamless metal piece.

6. A heat transfer device as claimed in claim 2 wherein each of said longitudinal holes meanders between said high and low temperature regions so as to describe a sinuous curved line which is one of an undulating plane curve, and a three dimensional helical curve.

7. A heat transfer device as claimed in claim 6 wherein said metal band comprises a plurality of straight band segments each extending from a first segment end located in said high temperature region to a second segment end located in said low temperature region, a plurality of first U-shaped band segments each connecting said first segment ends of two adjacent straight band segments in said high temperature region, and a plurality of second U-shaped band segments each connecting said second segment ends of two adjacent straight band segments in said low temperature region.

8. A heat transfer device as claimed in claim 7 wherein said metal band is oriented so that a widthwise direction of said metal band is parallel to a direction of a stream of a heat medium fluid flowing outside said metal band.

9. A heat transfer device as claimed in claim 7 wherein said straight band segments are flat and parallel to one another, and said metal band comprises first and second band surfaces each of which is substantially a ruled surface generated by moving a straight line along a sinuous curved line in a reference flat plane so that said straight line remains perpendicular to the reference flat plane.

10. A heat transfer device as claimed in claim 9 wherein said metal band is oriented in such a direction that a stream of a heat medium fluid flows in a direction perpendicular to said reference plane.

11. A heat transfer device according to claim 1 wherein each of the longitudinal holes extends from a first hole end to a second hole end along the longitudinal direction, the metal band comprises a first terminal lateral hole extending in a widthwise direction of the metal band, and connecting the first holes ends of the longitudinal holes and a second terminal lateral hole extending in the widthwise direction of the metal band, and connecting the second holes ends of the longitudinal holes, and the metal band comprising a seamless metal piece in which all the longitudinal holes and the first and second terminal lateral holes are formed.

12. A heat transfer device according to claim 1, wherein all the longitudinal holes are connected end to end in series so as to form a single continuous sinuous fluid passage in the metal band.

13. A heat transfer device according to claim 1, wherein the heat transfer device is a capillary tube type heat pipe device and each longitudinal hole is sized to form a capillary tube.

14. A heat transfer device comprising:

a metal heat pipe unit defining a sealed inside cavity partially filled, in a partial vacuum, with a predetermined amount of working fluid capable of condensation and vaporization, said metal heat pipe unit comprising a heat absorbing section for absorbing heat in a high temperature region, and a heat releasing section for releasing heat in a low temperature region;

wherein said metal heat pipe unit comprises a flexible platelike metal band which is made of a light metal, which extends along a longitudinal direction from a first longitudinal end to a second longitudinal end, and which is formed with a plurality of longitudinal holes extending along the longitudinal direction, said longitudinal holes being connected with one another to form said sealed inside cavity, there being no flow limiters within said longitudinal holes to limit the direction of flow of the working fluid therethrough; and wherein said metal band is bent in such a sinuous manner that said metal band extends back and forth between the high temperature region and the low temperature region, and streams of a heat medium fluid flow substantially parallel to the side faces of the platelike metal band in the regions between the bends.

* * * * *